US005934490A

United States Patent [19]

Mora

[11] Patent Number: 5,934,490

[45] **Date of Patent: *Aug. 10, 1999**

[54] COMBINATION ENGINE HOIST AND STAND

[76] Inventor: Arthur R. Mora, 12947 Ojai Rd., Ojai, Calif. 93060

[ * ] Notice: This patent is subject to a terminal disclaimer.

[21] Appl. No.: 08/375,630

[22] Filed: Jan. 20, 1995

Related U.S. Application Data

[63] Continuation-in-part of application No. 07/962,704, Oct. 19, 1992, abandoned.

[51] Int. Cl.[6] ..... B66C 23/48

[52] U.S. Cl. ..... 212/176; 212/301; 212/334; 212/901

[58] Field of Search ..... 212/175, 176, 212/177, 179, 180, 181, 294, 301, 901, 234

[56] References Cited

U.S. PATENT DOCUMENTS

| | | | |
|---|---|---|---|
| 1,284,277 | 11/1918 | Ewig et al. | 212/299 |
| 1,614,697 | 1/1927 | Snook | 212/901 |
| 2,804,979 | 9/1957 | Lassiter | 212/301 |
| 2,974,809 | 3/1961 | Sellars et al. | 212/203 |
| 3,367,512 | 2/1968 | Kaplan | 212/294 |
| 3,388,820 | 6/1968 | Lebre | 414/460 |
| 3,811,576 | 5/1974 | Fagen | 212/180 |
| 4,749,324 | 6/1988 | Rulison | 212/901 |
| 4,770,304 | 9/1988 | Woods | 212/901 |
| 4,806,063 | 2/1989 | York | 212/180 |
| 5,052,566 | 10/1991 | Ziegler | 212/901 |
| 5,076,448 | 12/1991 | Ballard | 212/901 |

*Primary Examiner*—Thomas J. Brahan
*Attorney, Agent, or Firm*—W. Douglas English

[57] ABSTRACT

A combination engine hoist and stand for lifting and supporting an engine includes a variably oriented "H" shaped multi hinged base with frame extension capability mounted on casters and a combined hoist and stand vertical column located on the base for communicating with and supporting both a hoist and a stand via a collar disposed therebetween. The hoist includes a boom and a hoist column, the boom pivotally attached to the hoist column and the hoist column attached to the stand column via the collar. The boom is manually adjustable for length via extension elements and the boom height is adjustable by activating a hydraulic jack. A wire rope depends from the outward extending end of the boom and is manually adjustable for length by operating a winch. The boom alone or the entire hoist is removable from the stand as desired. The stand includes a stand column and a shaft that pivotally and slidably communicates with the collar on the stand column and also includes a plate for attachment to an engine. Plate and shaft may likewise be removed from the hoist and stand combination leaving only the hoist supported by the stand column and base. The invention may be used to both remove an engine from an automobile and to support an engine for repair.

1 Claim, 2 Drawing Sheets

COMBINATION ENGINE HOIST AND STAND

This is a continuation in part of U.S. patent application Ser. No. 07/962,704 filed Oct. 19,1992, now abandoned.

BACKGROUND OF THE INVENTION

The present invention relates to engine stands and engine lifting devices. More specifically, but without limitation, the present invention relates to a portable, combination engine stand and hoist for lifting and supporting an automobile engine or other heavy equipment. It should be noted that the terms "engine hoist" and "engine stand" are the terms commonly used in the art to describe devices for lifting and supporting not only engines but also all types of heavy equipment such as transmissions, automobile rear ends and other objects commonly found in garages, machine shops and the like.

The removal of heavy engines from automobiles, with or without the transmission or transaxle attached, is normally accomplished by removing the hood and lifting the engine out the top of the vehicle. An engine hoist is normally used to accomplish the lifting task. Once removed, the heavy engine and/or transmission is transferred to a stand where disassembly and repair are performed. Many attempts have been made to provide both engine hoists and engine stands. U.S. Pat. No. 3,599,812 and Canadian Patent No. 887498 disclose pivoting arm type hoisting devices mounted on vertically extending columns and activated by hydraulic means to lift engines from vehicles. U.S. Pat. 4,508,223 discloses an arm type hoisting device with a telescoping support column and provides a feature that maintains a constant lifting angle as the arm is raised. Other devices have been developed for specialized hoisting applications such as removal of an engine from an automotive van. Such a device is shown in U.S. Pat. No. 4,497,469 and may be attached to a conventional floor hoist. However, separate engine hoisting devices and engine stands occupy considerable floor space in addition to being expensive.

Accordingly, combination units have been developed which reduce the amount of floor space utilized as well as reduce the cost by eliminating needless repetition of frame members, supports and casters, for example. Such a unit is shown in U.S. Pat. No. 4,588,165 which utilizes separate vertical supports for the hoisting unit and for the stand unit and may be separated into individual hoisting and stand units. Another unit, shown in U.S. Pat. No. 4,523,888 discloses a combination hoisting, handling and metal working machine.

While these known devices may be suitable for their intended purpose, none provides a truly compact unit that can: both easily and efficiently hoist and support an engine; utilize a minimum of components and provide for a removable tool tray; provide a common support column for both hoisting an engine from an automobile and mounting the engine on an engine stand; yield maximum floor space in and around the device; provide more versatility in orientation of its component parts and therefor more convenient access to loads in a tight space, and provide minimum interference by one part when utilizing the other part.

SUMMARY OF THE INVENTION

Accordingly, the preferred embodiment of the present invention provides a combination engine hoist and stand in a unitary device and includes a base substantially parallel to the floor and in an "H" configuration with casters located at the extreme outer ends of the "H" between the base and floor. The arms of the H shaped base are provided with base extension units and hinges at appropriate points to permit variable size and orientations of the support base, thereby permitting maximum utility of the unit in tight spaces. The base has a vertical stand column with a transverse collar welded on the end opposite the base for removably supporting a hoist and a stand. The hoist is attached to the collar located on top of the base column and includes: a vertical hoist column removably disposed on the collar; a boom extending from the hoist column, manually adjustable via boom extension units for length and hydraulically adjustable for height; and a vertically depending wire rope extending from a winch, across the boom, and down to a load. The stand slidably and pivotally communicates on one end through the collar located on top of the stand column and communicates on the other end with an engine or other load. The base shape with extensions and pivot point hinges provides flexibility, adaptability, and stability from overturning and maximizes floor space in and around the invention. The tool tray and stand may be removed from the engine hoist/stand combination entirely, as required, and the stand may be slidably positioned proximate the collar so that the hoist may be operated without interference from the tray or stand. When the stand is removed altogether or slidably positioned proximate the collar, the invention may be rolled in close to a vehicle engine bay wherein the boom may be adjusted to the shortest length possible by removing boom extensions after removal of the engine, the invention may be rolled in close to a vehicle engine bay wherein the boom may be adjusted to the shortest length possible by removing boom extensions After removal of the engine, the invention may be rolled away from the vehicle and the stand either attached or slidably positioned proximate the engine. The engine may then be transferred to the stand. The hoist, boom and hoist column, may then be removed as required, so that the stand may be operated without interference from the hoist. The single stand column and removable hoist column provides strength, maximum intrusion on working space and maximum economy by eliminating needless duplication of parts. In addition, the center of gravity will remain within the "H" section of the base for continued stability when supporting heavy loads.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
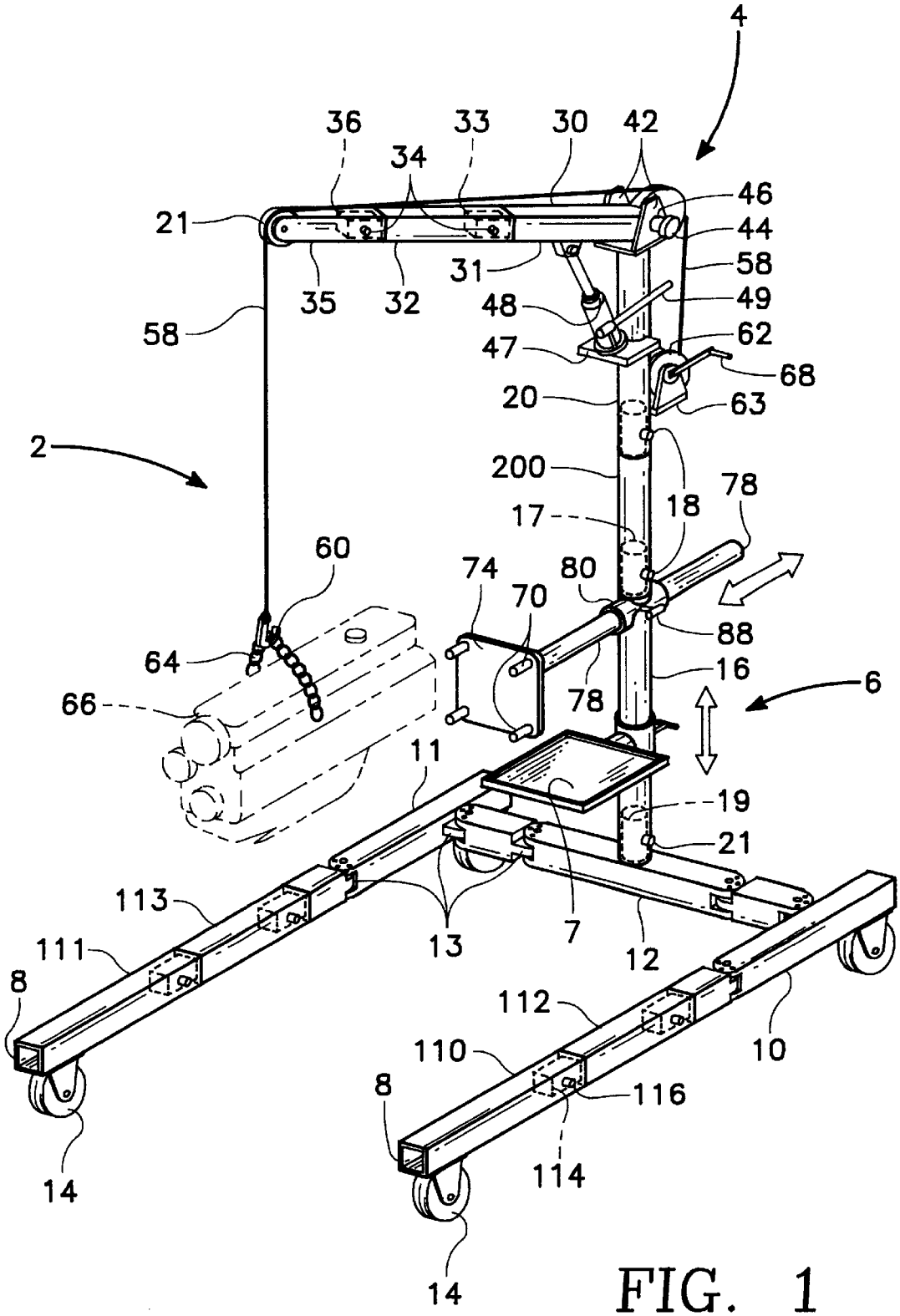
FIG. 1 is a perspective view of the invention.

The preferred embodiment of the present invention is illustrated by way of example in the overall perspective view of FIG. 1. As shown in FIG. 1, the combination engine hoist and stand 2 includes a hoist 4 with a hoist column 20 and a hoist boom 30, a stand 6 with a stand column 16 and a stand shaft 78, a tool tray 7, and a base 8 on a set of casters 14.

Figure 3:
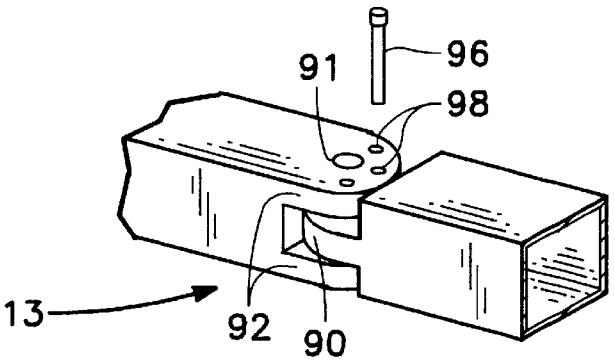
FIG. 3 is a perspective view of a swivel joint hinge of the invention.
Figure 2:
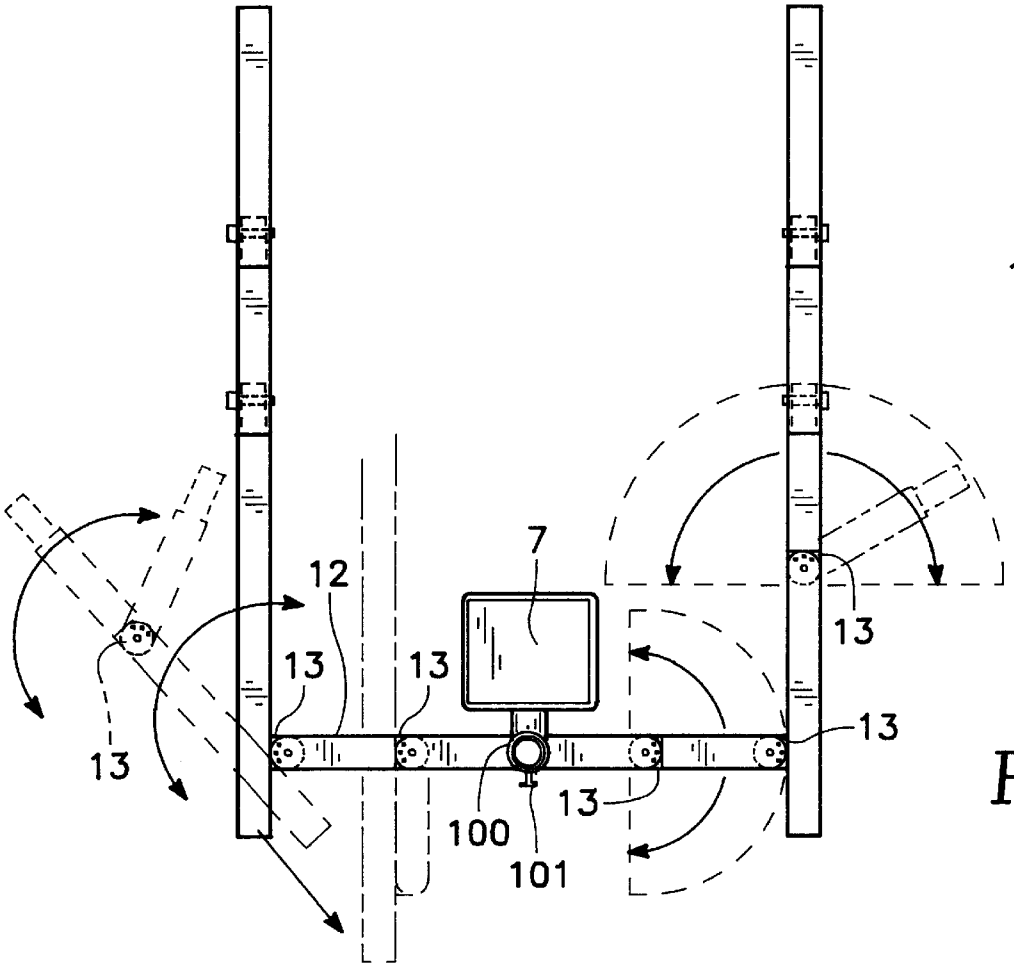
FIG. 2 is a top/plan view of the invention illustrating the variable length extension members and variable orientation of the swivel joint hinges.

Base 8 includes three interconnected frame members 10, 11 and 12 abuttably attached, for example, by several appropriately positioned swivel joint hinges 13 to form an "H" configuration. Base frame 8 can be reoriented at each hinge 13 and can be variably repositioned to adapt to the confining conditions in which the combination hoist and stand may be used as illustrated in FIG. 2. The "H" shape is derived basically from parallel members 10 and 11 being coupled together by crossmember 12 which is orthogonal to both members 10 and 11. Hinges 13 are more clearly illustrated in the blow up diagram of FIG. 3, wherein a lip 90 of one base frame member may be rotated between a pair of flanges 92 of another base frame member on a shaft pin 94 extending through lip 90 from one flange 92 to the other. Once a desired orientation of base 8 is obtained, a hinge pin 96 may be then be removably inserted in one of several positioning slots 98 to maintain the base frame in that desired orientation. Referring again to FIG. 2, it can be seen that a great variety of orientations of base 8 may be obtained to conveniently access unique and confined working conditions.

Figure 4:
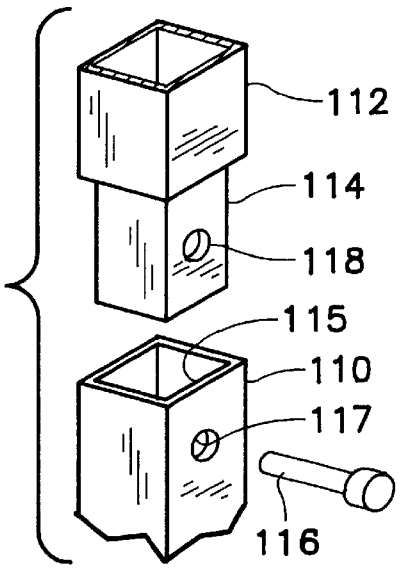
FIG. 4 is a perspective view of a boom extension element joint

Casters 14 are attached to the underside of each end of frame members 10 and 11 as shown in FIG. 1. Frame members 10, 11 and 12, as described above, form a structure substantially parallel to the floor upon which castes 14 sit. Frame members 10 and 11 are provided with primary base arms 10 and 11 and distal base arms 110 and 111, respectively, removably coupled thereto. At least one extension frame member 112 and 113 may be removably coupled between primary members 10 and 11 and distal members 110 and 111, respectively. The coupling mechanism between each said member is illustrated in the blow up diagram of FIG. 4 and consists of a terminal end 114 of reduced diameter configured to fit within an accompanying frame member open end 115. Upon insertion of a terminal end 114 into an open end 115, a fastening pin 116 is provided for insertion through overlapping and matched bore holes 117 and 118 to removably hold the frame components together.

Stand column 16 is abuttably attached and perpendicular to frame member 12. Preferably stand column 16 is a circular, hollow member removably attached to frame member 12 by inserting a smaller diameter mounting cylinder 19, welded to frame member 12, into the end of stand column 16 and securing each in place by a locking pin 21.

Hoist column 20 of hoist 4 is attached to stand column 16 via a collar 80 which is located between hoist column 20 and stand column 16. Hoist column 20 and stand column 16 are attached to collar 80 by inserting a smaller diameter mounting cylinder 17, welded on top collar 80, into the end of hoist column 20 and removably securing each in place with a locking pin 18. As is illustrated in FIG. 1, hoist column 20 may be increased in height by insertion of and extension hoist column 200 between column 20 and collar 80. By such means, stand column 16 and hoist column 20 comprise essentially a single, multi sectional column supporting both hoist 4 and stand 6. Braces, not illustrated, may also be secured to hoist column 20 at the brace upper ends and secured to frame member 12 at the brace lower ends by removable locking pins or bolts (not shown).

Tool tray 7 is configured to be raised and lowered by a sleeve 100 slidably disposed on stand column 16 and is secured in place thereon by a tightening handle 101. It is conceived that tool tray 7 may also be conveniently provided with a hinge to fold alongside column 16 or alternatively may be provided with a release mechanism such that the tray may be removed entirely in confined spaces.

Boom 30 of hoist 4 includes a primary boom element 31 and a terminal boom element 35 with at least one boom extension element 32 inserted therebetween. Terminal and extension elements 35 and 32, respectively, slidably communicates in a telescoping manner with the smaller diameter terminus 36 of extension element 32 and the smaller diameter terminus 33 of primary element 31. Terminus 33 of primary element 31 is designed to be inserted in the end of extension element 32 or the end of terminal element 35, and removably secured therein by a locking pin 34. In operation, the length of boom 30 may be adjusted by adding or deleting extension elements 32. In the preferred embodiment, boom 30 and its elements, primary element 31, extension elements 32, and terminal element 35 have a square cross section. Parallel ears 42 are attached, for example, by welding to the top of hoist column 20 and include aligned bores 44. One end of primary element 31 is located between parallel ears 42 and pivotally communicates with ears 42 of hoist column 20 via a removable bolt 46. Thus hoist boom 30 alone may be removed from hoist column 20 as desired or alternatively the entire hoist 4, boom and column, may be removed as described above. Hydraulic jack 48 with handle 49 controls the rotation of boom 30 about bold 46 and thus controls the height of boom 30 and, in part, elevation of a load 66 above the ground. The base of jack 48 is pivotally attached to hoist column 20 via a jack platform 47 welded to hoist column 20 and the other end of jack 48 is pivotally attached to boom primary element 31. Wire rope 58 is attached to a hook 60 on one end and to a manual winch 62 bolted to a winch seat 63 welded or bolted to hoist column 20 on the other end. Although winch 62 is manual in the preferred embodiment, it is equally as likely that winch 62 may be electrically powered or self powered by other means conventional in the art. Pulley 21, attached to the outward extending end of boom terminal element 35, effects a smooth direction change of wire rope 58. Hook 60 is attached to a chain 64 which in turn is attached to a load, e.g. engine 66. Crank 68 may be turned by hand to operate winch 62. It can thus be seen that the length of boom 30 may be adjusted by the telescoping action of extension elements 32; that the angle of boom 30 may be altered by extending or retracting hydraulic jack 48; that the length of wire rope 58 may be altered by manipulating winch 62 in either a forward or reverse direction; and that the position of the entire combination engine hoist and stand may be altered by rolling on casters 14. In addition, the center of gravity will remain within the area bounded by base frame members 10, 11, 12. Stability from overturning is thus ensured and, due to the double extending base frame members 10 and 11, floor space around engine 66 is maximized.

Once an engine 66 has been removed from a vehicle, it may be transferred to stand 6 where disassembly and repair may be effectuated. Stand 6 is attached on one end to engine 66 by a mounting plate 74 which is welded to shaft 78 which in turn communicates with and slidably through collar 80 on the other end. Bolts 70 extend from mounting plate 74 and communicate with engine 66. Spacers may conventionally be provided to maintain engine 66 away from plate 74. Shaft 78 attaches to plate 74 on one end and slidably communicates through collar 80 on the other end. Wingnut 88 may be tightened to lock shaft 78 in a chosen position. It may thus be seen that shaft 78 and therefor mounting plate 74 may be rotated three hundred sixty degrees. In addition, stand 6, i.e. shaft 78 and mounting plate 74, may be removed altogether to allow hoist 4 to be operated without interference from stand 6.

Obviously many modifications and variations of the present invention are possible in light of the above teachings. It is therefore to be understood that within the scope of the appended claims, the invention may be practiced otherwise than as specifically described.

What is claimed is:

1. An engine hoist-stand assembly, comprising:

a mobile H-shaped base frame having a pair of multi sectioned and extendible, parallel leg members with at least one hinged section disposed on each said leg member thereby enabling said parallel leg members to be lengthened and shortened and to swivel about each said hinge section thereby enabling a variety of different geometrical orientations of said H-shaped base frame for more effective use and operation of said engine hoist-stand in a variety of confining work environments;

at least one cross member disposed between said parallel leg members with at least one hinged section disposed on each end of said cross member coupling said cross member to each said leg member, thereby further enabling unique geometrical configurations of said H-shaped base frame and for enabling a compact foldability of said H-shaped base frame for storage and shipping;

a vertical stand column removably disposed upon and extending from a central position on said cross member and having a collar disposed on a distal end of said stand column for translational, slidable and rotational containment therein of an engine stand shaft and engine mounting plate thereon;

a dual lift capacity engine hoist having a multi sectioned and extendible vertical hoist column removably disposed upon and extending from said collar and having a multisectioned and extendible boom pivotally and removably coupled to a distal end of said hoist column for a first lifting capacity, said boom supporting a cable extending over and depending from said boom for a second lifting capacity;

means for easily and conveniently removing said engine hoist from said engine hoist-stand assembly leaving an operable engine stand alone and for easily and conveniently removing said engine stand shaft from said engine hoist-stand assembly leaving an operable engine hoist alone;

means removably coupled to said hoist column for elevating and lowering said boom and therefor a load depending therefrom; and means removably coupled to said hoist column for elevating and lowering said cable and therefor a load positioned thereon.

* * * * *